US007178263B2

(12) United States Patent
Asano et al.

(10) Patent No.: US 7,178,263 B2
(45) Date of Patent: Feb. 20, 2007

(54) METHOD OF MANUFACTURING INCOMBUSTIBLE WOOD

(75) Inventors: Nariaki Asano, Fukui-ken (JP); Hiroya Asano, Fukui-ken (JP); Takahito Asano, Fukui-ken (JP)

(73) Assignee: Asano Mokuzai Industry Co., Ltd., Fukui-ken (JP)

( * ) Notice: Subject to any disclaimer, the term of this patent is extended or adjusted under 35 U.S.C. 154(b) by 105 days.

(21) Appl. No.: 10/495,776

(22) PCT Filed: Nov. 15, 2002

(86) PCT No.: PCT/JP02/11954

§ 371 (c)(1),
(2), (4) Date: May 14, 2004

(87) PCT Pub. No.: WO03/041925

PCT Pub. Date: May 22, 2003

(65) Prior Publication Data

US 2005/0000111 A1 Jan. 6, 2005

(30) Foreign Application Priority Data

Nov. 16, 2001 (JP) ..... 2001-352476

(51) Int. Cl.
*F26B 3/00* (2006.01)
*F26B 5/04* (2006.01)
*F26B 7/00* (2006.01)

(52) U.S. Cl. ..... 34/357; 34/358; 34/396; 34/404; 34/409; 34/418; 34/423

(58) Field of Classification Search ..... 34/329, 34/357, 358, 406, 409, 418, 423, 396, 92, 34/402–404; 252/601, 607; 427/297, 440
See application file for complete search history.

(56) References Cited

U.S. PATENT DOCUMENTS 3,968,276 A * 7/1976 Allen ..... 427/297
5,461,108 A * 10/1995 Lewis ..... 524/596
5,970,624 A 10/1999 Moriya

FOREIGN PATENT DOCUMENTS

JP 60-42003 3/1985
JP 4-234603 8/1992

(Continued)

*Primary Examiner*—Jiping Lu
(74) *Attorney, Agent, or Firm*—Flynn, Thiel, Boutell & Tanis, P.C.

(57) ABSTRACT

Provided is a method of manufacturing incombustible wood that enables maximization of the amount of an incombustion agent used to be impregnated into wood. Further provided is a method of manufacturing incombustible wood that completely satisfies incombustible-wood conditions required by the Building Standard law and that can be relatively easily manufactured. The method of manufacturing incombustible wood includes performing plural times of individual drying steps for drying wood (for example, board material B), decompression steps for decompressing the wood, decompression impregnation steps for impregnating the wood with an incombustibility treatment agent in a decompressed state, and compression impregnation steps for impregnating the wood with the incombustibility treatment agent in a compressed state, wherein two times of the individual decompression steps, individual decompression impregnation steps, and compression impregnation steps are performed, and three times of the drying steps are performed.

9 Claims, 5 Drawing Sheets

FOREIGN PATENT DOCUMENTS

| | | |
|---|---|---|
| JP | 8-336811 | 12/1996 |
| JP | 9-277209 | 10/1997 |
| JP | 11-277506 | 10/1999 |
| JP | 2001-200255 | 7/2001 |
| WO | WO 97/46358 | 11/1997 |
| WO | WO 99/13022 | 3/1999 |

* cited by examiner

METHOD OF MANUFACTURING INCOMBUSTIBLE WOOD

TECHNICAL FIELD

Technical Field to which the Invention Relates

The present invention relates to incombustible wood, and more specifically to a method of manufacturing incombustible wood by impregnating the wood by an incombustibility treatment.

BACKGROUND ART

Prior Art

Conventionally, from the viewpoints of, for example, light weight, grain, and processability, wood is widely used for buildings such as housings.

However, a major drawback of the wood in use as a building material is high combustibility, so that various processes for introducing a fire-retardant property to wood have been and are in the development.

In conjunction therewith, also application fields thereof have been and are widened.

For example, since the Building Standard law regarding doorframes was revised (1990), use of wood has been permitted for opening portions. As such, development for fire retardation processes has been advancing to satisfy requirements of the standard regarding a flame-penetration resistance, specifically requiring 60-minute resistance for first-class materials and 20-minute resistance for second-class materials.

At present, by way of an example of a fire retardation process, there is a method in which wood is impregnated with a fire retardant, such as a water-soluble inorganic compound composed of boric acid, borax, and the like.

According to the process of impregnation with the fire retardant, the wood tissue can be physically penetrated (impregnated) with chemicals such as borax and boric acid by decompression or compression (for example, as in steps shown in FIG. 4, drying step→decompression step→decompression impregnation step→compression impregnation step→drying step). Thus, the processing steps are not complicated, so that the process is relatively popularly employed.

For example, in the process, the wood is first dried to a predetermined moisture content.

Subsequently, the wood is degassed by being decompressed to a level permitting an incombustion agent to penetrate as in that state, and is compressed to allow the agent to further penetrate.

Thereafter, the wood is dried to cause incompatible liquid to be fixedly impregnated in the wood tissue.

Fire-retardant wood is manufactured in accordance with the processing steps described above.

In addition, it is necessary to satisfy the requirements of the standard for incompatibility testing (heating-rate testing: ISO 5660), which is required as a condition of, for example, fire-retardant material (fire-retardant wood) and an incompatible material (incombustible wood) defined in the present Building Standard law.

The standards are shown in Table 1.

According to the standards, the following requirements should be satisfied under testing conditions of a heating time of 20 minutes and an emission intensity of 50 kW/m$^2$ for satisfying the requirements of the incombustible-wood standard.

1) A total heating value shall be 8 MJ/m$^2$ or lower.

2) Neither crack nor pore passing through to a reverse side, which is detrimental to fire retardation, shall be present.

3) A maximum heating rate shall continue for 10 seconds or longer and shall not exceed 200 kW/m$^2$.

In addition to the requirements of the standard for combustive exothermicity, requirements of the standard regarding gas toxicity, described below, should be satisfied.

4) In gas toxicity testing, an average deactivation time of a mouse shall be 6.8 minutes or longer.

However, according to the above-described conventional process that performs, for example, the decompression impregnation and the compression impregnation, and the like, while the requirements of the standard for fire-retardant wood and semi-incombustible wood can be satisfied, the requirements of the standard for incombustible wood cannot be satisfied.

More particularly, a bottleneck is imposed in that the condition 1), which requires the total calorific value of 8 MJ/m$^2$ of lower, cannot be satisfied.

To satisfy the condition, a method in which an incombustibility treatment agent is impregnated as much as possible into the wood tissue has been considered effective and has been and is put into practice on a trial basis.

More specifically, from the viewpoint that it is effective to iterate the impregnation step to achieve impregnation with a large amount of the incombustion agent, drying (drying step) is firstly performed and decompression is then performed for impregnation (decompression impregnation step). Thereafter, a step of compression for impregnation (compression impregnation step) is performed, and further, the routine of decompression impregnation step→compression impregnation step is iterated (refer to FIG. 5).

However, even when the routine of the decompression impregnation step→compression impregnation step is iterated a certain number of times, while the incombustibility treatment agent is impregnated into a region at a certain depth of the wood tissue, the agent does not reach a region deeper than the region.

That is, a limitation inevitably takes place on the amount of the incombustibility treatment agent that can be impregnated into the wood tissue.

As described above, it is a present state that incombustible wood that satisfies the requirements of the standard for the incombustible wood according to the Building Standard law has not been provided to date.

Problems to be Solved by the Invention

The present invention is aimed to solve the problems described above.

Specifically, an object of the present invention is to provide a method of manufacturing incombustible wood enabling maximization of the amount of an incombustible agent that is to be impregnated into the wood.

Another object is to provide a method of manufacturing incombustible wood that completely satisfies incombustible-wood conditions required by the Building Standard law and that can be relatively easily manufactured.

DISCLOSURE OF INVENTION

Means for Solving the Problems

In view of the above-described problems, the inventors of the present invention conducted a number of extensive studies and researches. As a result, the inventors found that the process performed in the manner that the decompression impregnation step and the compression impregnation step are not simply iterated, but one drying step is added before the iteration and the decompression impregnation step and the compression impregnation step are iterated thereafter contributes to the action of penetration of the incombustible agent into the wood tissue with a more significant effect than expected. The present invention has been made based on knowledge acquired with the discovery.

Specifically, the present invention lies in (1) a method of manufacturing incombustible wood, comprising performing plural times of individual drying steps for drying the wood, decompression steps for decompressing the wood, decompression impregnation steps for impregnating the wood with an incombustibility treatment agent in a decompressed state, and compression impregnation steps for impregnating the wood with the incombustibility treatment agent in a compressed state, the method being characterized in that two times of the individual decompression steps, individual decompression impregnation steps, and compression impregnation steps are performed, and three times of the drying steps are performed.

The present invention further lies in (2) a method of manufacturing incombustible wood, comprising a first drying step wherein wood is dried; a first decompression step wherein, after being dried by the first drying step, the wood is decompressed in a decompressed vessel; a first decompression impregnation step wherein, after being decompressed by the first decompression step, the wood is immersed in an incombustibility treatment agent in the decompressed vessel to impregnate a tissue of the wood with the incombustibility treatment agent; a first compression impregnation step wherein, after being impregnated by the first decompression impregnation step, the wood is compressed in a state where the wood is immersed in the incombustibility treatment agent in a vessel to impregnate the tissues of the wood with the incombustibility treatment agent; a second drying step wherein, after being impregnated by the first compression impregnation step, the wood impregnated with the incombustibility treatment agent is dried; a second decompression step wherein, after being dried by the second drying step, the wood is decompressed in a decompressed vessel; a second decompression impregnation step wherein, after being decompressed by the second decompression step, the wood is immersed in the incombustibility treatment agent in the decompressed vessel to again impregnate the tissues of the wood with the incombustibility treatment agent; a second compression impregnation step wherein, after being impregnated by the second decompression impregnation step, the wood is compressed in a state where the wood is immersed in the incombustibility treatment agent in a vessel to again impregnate the tissue of the wood with the incombustibility treatment agent; and a third drying step wherein, after being impregnated by the second compression impregnation step, the wood impregnated with the incombustibility treatment agent is dried.

The present invention further lies in (3) the method of manufacturing incombustible wood, wherein in the first drying step, drying is performed by heat drying to a moisture content of 15% or lower.

The present invention further lies in (4) the method of manufacturing incombustible wood, wherein in the second drying step, drying is performed by heat drying to a moisture content of 30% or lower.

The present invention further lies in (5) the method of manufacturing incombustible wood, wherein in the third drying step, drying is performed by heat drying to a moisture content of 15% or lower.

The present invention further lies in (6) the method of manufacturing incombustible wood, wherein in the decompression steps, processing is performed for a predetermined time at a negative pressure of −1.0 MPa to −0.7 MPa.

The present invention further lies in (7) the method of manufacturing incombustible wood, wherein in the decompression steps, processing is performed for a predetermined time at a compression level of 0.7 MPa to 2.0 MPa.

The present invention further lies in (8) the method of manufacturing incombustible wood, wherein in a state where the third drying step has been completed, the incombustibility treatment agent in solids amount is 240 kg/m$^3$ or greater.

The present invention further lies in (9) the method of manufacturing incombustible wood, wherein the process temperature of the incombustibility treatment agent in the second compression impregnation step is 60 to 90° C.

The present invention further lies in (10) the method of manufacturing incombustible wood, wherein the incombustion treatment agent is a treatment agent containing at least borax, boric acid, and phosphoric acid.

The present invention may be configured by combining two or more selected from the above items (1) to (10) as long as they conform to the objects.

EFFECTS OF THE INVENTION

In the method of manufacturing incombustible wood according to the present invention, the processing steps are carried out as: first drying step→first decompression impregnation step→first compression impregnation step; then second drying step; and thereafter, second decompression impregnation step→second compression impregnation step→third drying step. This enables the incombustibility treatment agent to be sufficiently impregnated into a deep region of the wood tissue.

Thereby, the incombustible wood capable of satisfying the requirements of the Building Standard law can be provided for the first time. Further, the method of manufacturing incombustible wood can be implemented by the provision of the drying steps in the series of processing steps, thereby providing an advantage in that specifically dedicated manufacturing steps are not necessary, but the manufacture can easily be accomplished using conventional manufacturing apparatuses.

BRIEF DESCRIPTION OF THE DRAWINGS

FIGS. 3(A) and 3(B) are views showing an outline of the tissue of a hermetic vessel used in manufacturing steps according to the present invention, in which FIG. 3(A) shows a state before filling of an incombustibility treatment agent, and FIG. 3(B) shows a state after filling the incombustibility treatment agent.

BEST MODE FOR CARRYING OUT THE INVENTION

Embodiment of the Invention

Figure 1:
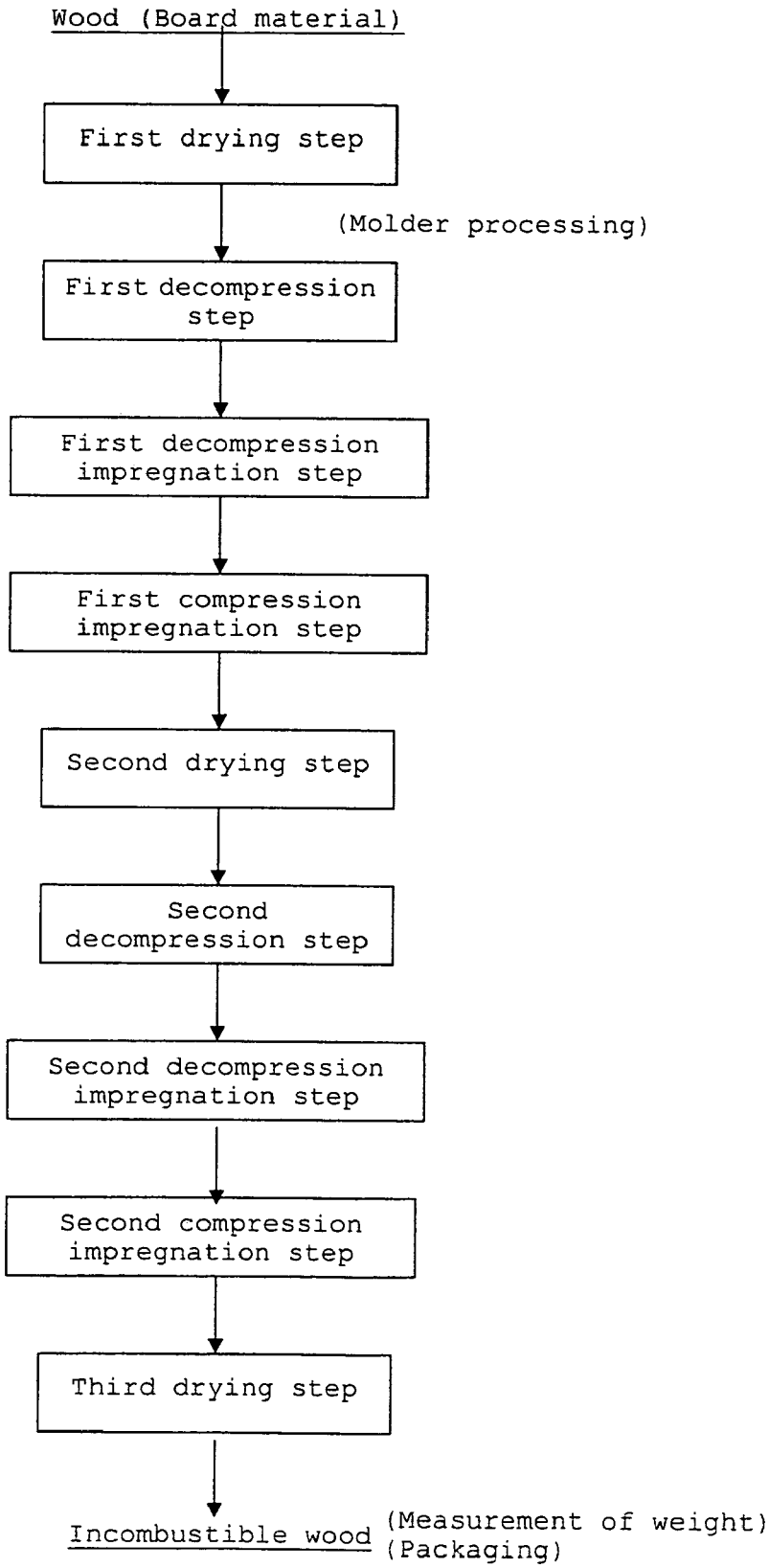
FIG. 1 is a view showing individual steps to achieve a method of manufacturing incombustible wood according to an embodiment of the present invention.

Referring to the drawings, the present invention will be described hereunder with reference to a practical embodiment.

Incombustible wood of the present invention is made using an incombustibility treatment agent, and the invention may be applied to various kinds of wood, such as a cryptomeria, pine, and cypress, inasmuch as the wood can be impregnated with an incombustibility treatment agent.

The incombustibility treatment agent used in the present invention may be an ordinarily used one; and in particular, a treatment agent containing at least borax, boric acid, and phosphoric acid can be preferably used.

Depending on the necessity, the treatment agent may be appropriately added with an additive such as an organic leaching preventive.

Examples of organic leaching preventives include, for example, acetic acid and phenol-based compounds that are used for adhesives.

FIG. 1 is a view showing the principal steps for achieving a method of manufacturing incombustible wood according to the embodiment of the present invention.

Firstly, wood to be processed is cut into boards, each having a predetermined size (24 mm×120 mm×2 m, for example).

First Drying Step

Subsequently, boards B thus cutting-processed are put into a drying vessel (or a drying chamber) and dried therein.

For the drying vessel to be used, a general-use steam-type dryer is used. For example, the steam-type dryer having a size of 3 m (vertical and horizontal dimensions)×10 m (length) is used.

The boards are each dried at a heating temperature of 40 to 90° C. for a predetermined time (about 4 to 7 days, for example) to, preferably, a moisture content of 15% or lower (7%, for example).

From the viewpoint of penetration efficiency of the incombustibility treatment agent, the board is preferably processed into an air-dried state with a moisture content of 15% or lower (state with less moisture content variations due to hygroscopic sorption).

Figure 2:
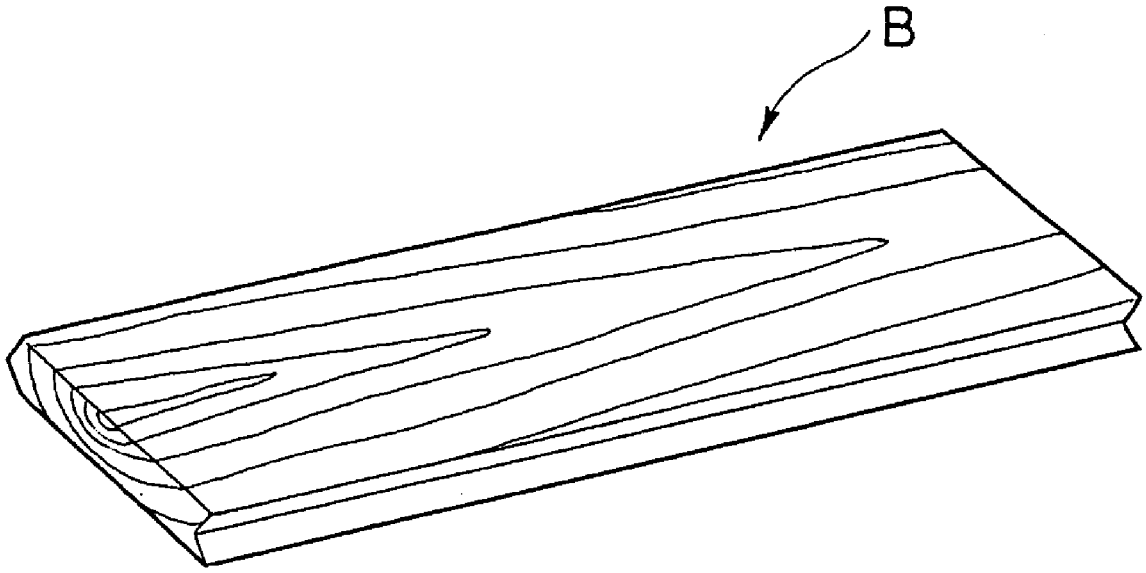
FIG. 2 is a view showing an example (floor board) as a wood material.

Thereafter, the board is cut by molder processing for corner portions thereof and processed into a shape similar to a product (for use as a floor board B) shown in FIG. 2.

A wide board area can be formed in the manner that boards individually shaped as described above and shown are serially assembled with one another.

The individual boards to be disposed in the drying vessel are preferably stacked to be efficiently dried.

In this case, for example, a support member (such as a spacer) is interposed between the individual boards to maintain a spacing of about 20 to 30 mm between the individual wood boards.

First Decompression Step

Subsequently, the boards dried to a moisture content of 15% through the drying step are re-stored in a hermetic vessel (usable also as a decompression or compression vessel).

Figure 3A:
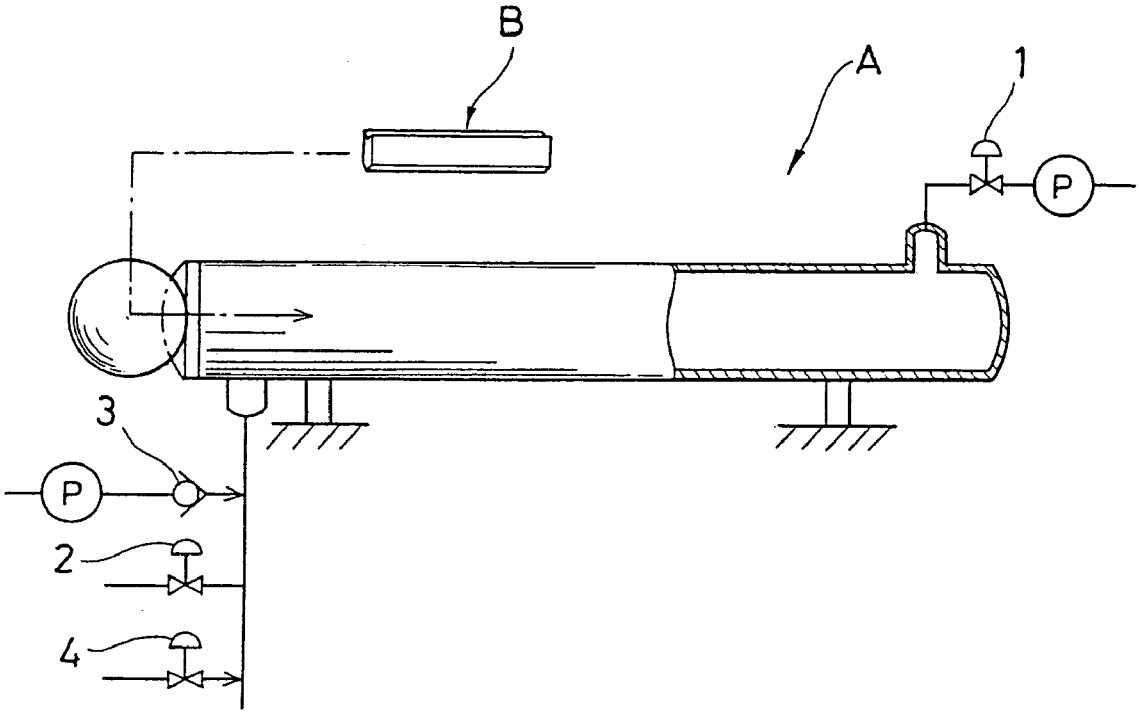

As the outline of the tissue is shown in FIG. 3, a hermetic vessel A has a size of about 1.5 (diameter)×9.5 mm (length), and has a pressure-reducing valve 1 communicating with a vacuum pump, a treatment-agent supply valve 2, a treatment-agent compression 3 communicating with a compression pump, and a treatment-agent exhaust valve 4, for example (refer to FIG. 3(A)).

In this case, similar to the drying step described above, the boards disposed in the hermetic vessel are preferably stacked with spacers interposed to efficiently perform decompression.

The pressure-reducing valve of the hermetic vessel is opened and decompressed to a negative pressure of −1.0 to −0.7 MPa (MegaPascals) and left in that state for a predetermined time (about 30 to 90 minutes, for example).

From the viewpoint of air discharge efficiency, the negative pressure is preferably set to fall in the range described above.

The decompression as described above causes the wood tissue (primarily formed of an aggregate of tracheids) to be negatively pressurized, thereby enabling an efficient impregnation action in a subsequent compression impregnation step.

First Decompression Impregnation Step

Subsequently, from the decompressed state in the decompression step, the treatment-agent supply valve 2 of the hermetic vessel is opened, and a heated incombustibility treatment agent is quickly filled thereinto.

In this step, from the viewpoint of impregnation efficiency in a subsequent first compression impregnation step, the heating temperature is preferably 40° C. or higher.

However, a temperature exceeding 90° C. facilitates occurrence of "inner split," "collapse," and/or like phenomena.

The filing is preferably performed in a filling time of 10 to 15 minutes. As the supply of the liquid agent advances, the decompression level is gradually reduced down substantially to the level of atmospheric pressure at final.

The board in the hermetic vessel is immersed in the incombustibility treatment agent, whereby the incombustibility treatment agent is introduced into the negatively pressurized wood tissue.

For the incombustibility treatment agent used in this step, an incombustibility treatment agent suitable to the board is selectively used.

First Compression Impregnation Step

Figure 3B:
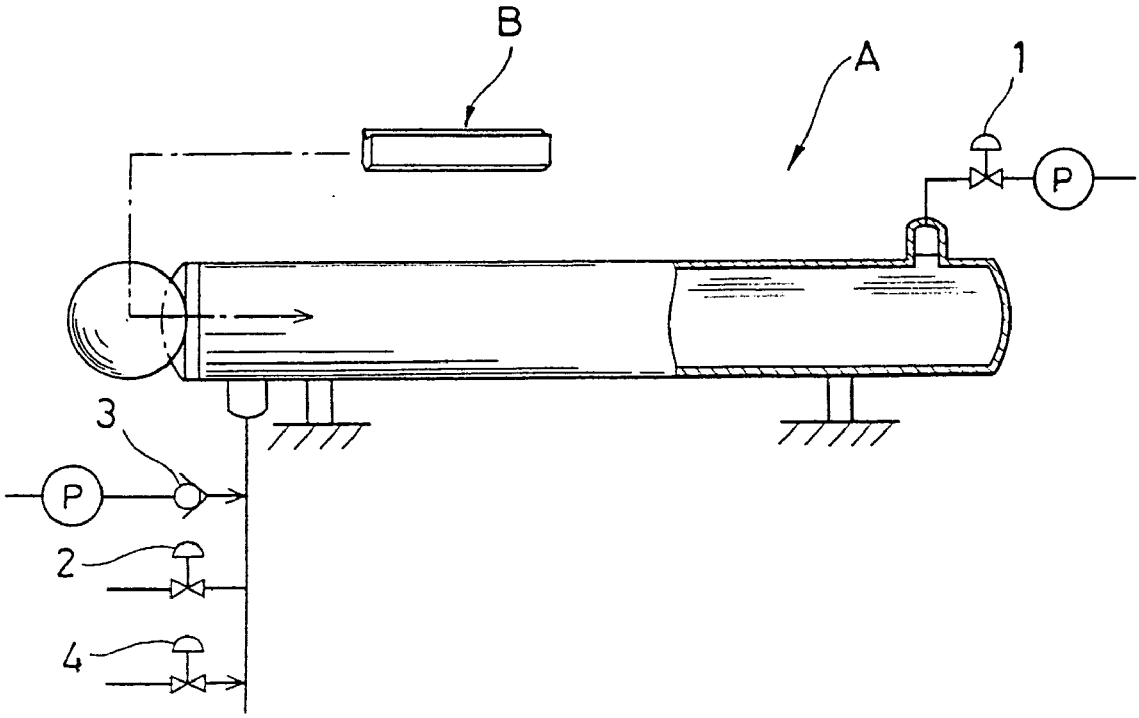

Subsequently, after the first decompression impregnation step, in the state where the board is kept immersed in the vessel, the interior of the hermetic vessel filled with the incombustibility treatment agent is compressed (refer to FIG. 3(B)).

More specifically, the pressure-reducing valve is closed, the incombustibility treatment agent is compressed through the treatment-agent compression 3, and the interior of the hermetic vessel is thereby conditioned to 0.7 to 2.0 MPa. Then, while the temperature of the incombustibility treatment agent is being maintained, the above-described state is maintained for a predetermined time (about 30 to 120 minutes, for example).

The compression level in the aforementioned range is preferable from the viewpoint of penetrability of the treatment agent and preventability of deformation of the board.

Although the hermetic vessel used in the previous steps, such as the decompression step and the decompression impregnation step, has been used, a different compression vessel may of course be used.

Also in the compression impregnation step, the boards are preferably stacked.

The compression performed in this manner enables compression to a deep region of the wood tissue.

Consequently, while the incombustibility treatment agent of course penetrates into the wood tissue in the first decompression impregnation step, a new volume of the incombustibility treatment agent further penetrates into the wood tissue.

Second Drying Step

Subsequently, the boards, which have been impregnated with the incombustibility treatment agent according to the first compression impregnation step, are re-stored in a drying vessel and are again dried therein.

For the drying vessel, it is effective to employ the same drying vessel as that used in the first drying step.

In this drying step, the board is preferably dried at a condition of 40 to 90° C. for a predetermined time (about 8 to 14 days, for example) to a state where the moisture content thereof is 30% or lower.

In this case, the moisture content need not be reduced to the level in the above-described first drying step, from the viewpoint of penetration efficiency of the treatment agent.

According to the drying, the incombustibility treatment agent penetrates into the board and is solidified and fixed in the tissue thereof.

When the incombustibility treatment agent is dried and solidified in the tissue, the volume of the treatment agent is reduced with some air spacing remaining in the tissue.

The second drying step is an intermediate step in the entire process, so that it is a very important step and is essentially required to finally cause the incombustibility treatment agent to be fixable to at least a level of about 240 $kg/m^3$.

Second Decompression Step

Subsequently, the boards dried to a moisture content of 30% through the second drying step are re-stored into a hermetic vessel similar to that used in the above-described first decompression step, first decompression impregnation step, and first compression impregnation step.

The incombustibility treatment agent in the hermetic vessel has already been discharged through the treatment-agent exhaust valve 4. Also, in this step where the board is decompressed, it is preferable that the decompression processing be again conducted to a negative pressure of −1.0 to −0.7 MPa for a predetermined time (about 30 to 90 minutes, for example).

By the decompression thus performed, the negative pressure extends to a deep region of the tissue in which the incombustibility treatment agent has not yet been penetrated and fixed.

Second Decompression Impregnation Step

Subsequently, from the decompressed state in the second decompression step, the hermetic vessel is filled with the incombustibility treatment agent heated (to 60 to 90° C.) by opening the treatment-agent supply valve of the hermetic vessel.

In this step, from the viewpoint of impregnation efficiency in a subsequent second compression impregnation step, the heating temperature is preferably 40° C. or higher.

However, a temperature exceeding 90° C. facilitates the occurrence of "inner split," "collapse," and/or like phenomena.

In this step also, the filling is preferably quickly performed in 10 to 15 minutes. As the supply of the liquid agent advances, the decompression level is gradually reduced down substantially to the level of atmospheric pressure finally.

Second Compression Impregnation Step

Subsequently, in the state where the board is kept immersed in the incombustibility treatment agent in the vessel, the hermetic vessel filled with the incombustibility treatment agent is again compressed to cause the wood tissue to be impregnated with the incombustibility treatment agent in the second decompression impregnation step.

Also, in the step, the pressure-reducing valve is closed, the incombustibility treatment agent is compressed through the treatment-agent compression 3, and the interior of the hermetic vessel is thereby conditioned to 0.7 to 2.0 MPa. Then, while the temperature of the incombustibility treatment agent is being maintained, the above-described state is maintained, preferably, for a predetermined time (about 90 to 180 minutes, for example).

By the compression thus performed, the incombustibility treatment agent penetrated into the wood tissue in the above-described second decompression impregnation step is even more securely penetrated into a deep region, thereby enabling the enhancing of the degree of treatment-agent impregnation.

That is, components of the incombustibility treatment agent fixed in the wood tissue by the second drying step are again compressed and melted at a high temperature. This enables the incombustibility treatment agent with an even higher concentration to finally be infiltrated into an even deeper region of the wood tissue.

As such, the treatment liquid temperature in the second compression impregnation step is preferably a temperature causing the solidified treatment agent to melt.

In the event of a boric-acid based incombustibility treatment agent (such as a treatment agent containing, for example, borax (sodium borate), boric acid, and phosphoric acid), the borax, boric acid, and phosphoric acid fixed in the second drying step can be again efficiently melted. For this reason, this treatment agent is preferably heated and maintained at 60 to 90° C.

Although the hermetic vessel used in the previous steps, such as the decompression step and the decompression impregnation step, has been used, a different compression vessel may of course be used.

Third Drying Step

Subsequently, the boards impregnated with the incombustibility treatment agent in the second compression impregnation step are re-stored in the drying vessel, and are again dried.

For the drying vessel, it is effective and economical to employ the same drying vessel as that used in the first drying step and second drying step.

The drying in this case is performed as final-stage drying or finishing heat drying. The board is preferably dried at a condition of 50 to 90° C. for a predetermined time (about 8 to 14 days, for example) to a state where the moisture content thereof is 15% or lower.

By the drying, also the incombustibility treatment agent penetrated into a deep tissue of the board is solidified and fixed in the tissue.

Upon having made the moisture content of the board to 15% or lower, a product (incombustion-treated board) is completed.

With the 15% or lower moisture content having been attained, there by produced advantages in that, for example, the adhesiveness of paint, an adhesive, or the like to the product is improved.

In this step, the incombustibility treatment agent contained in 1 $m^3$ of wood, in terms of solids weight (solids amount), is preferably 240 $kg/m^3$ or greater.

Weight Measurement

The board processed into the product is measured for the weight, and is subjected to surface-planing processing by necessity to produce a board having a predetermined weight.

Packing

A plurality of boards are packed and stored.

As described above, the processing steps are carried out as: first drying step→first decompression impregnation step→first compression impregnation step; then second drying step; and further, second decompression impregnation step→second compression impregnation step→third drying step. Through these processing steps, the incombustibility treatment agent can be sufficiently impregnated into the tissue; and specifically, 240 kg/m$^3$ or greater in terms of solids amount can be impregnated thereinto.

Although the present invention has been described as above, the invention is not limited by the embodiment, but various other modified examples can of course be implemented without departing from the essentials of the present invention.

Specifically, depending on the kind of wood, some changes are made to the decompression level (negative pressure level) and the temperature in the decompression steps, the temperature of the incombustibility treatment agent, the compression level and the temperature in the compression impregnation steps, the temperature, the time, and the moisture content in the drying steps, for example.

The method of manufacturing incombustible wood according to the present invention will be described hereunder with reference to an example.

EMBODIMENT EXAMPLE

Two test pieces (cryptomeria boards) were prepared: one having a size of 100 mm (width)×100 mm (length)×24 mm (thickness) and the other having a size of 100 mm (width)×100 mm (length)×24 mm (thickness).

Then, a process as the method of manufacturing incombustible wood according to the present invention was performed.

Specifically, first, the two test pieces were dried in a drying vessel (supplied by Shin-Shiba Setsubi Kougyo Co., Ltd.) in a heating temperature range of 45 to 70° C. for six days to a moisture content of 7% (first drying step).

Subsequently, the test pieces were put into a decompression-dedicated hermetic vessel (supplied by Hanayama Kogyo Co., Ltd.) and were tested for 60 minutes by conducting decompression to a negative pressure of −0.98 MPa (first decompression step).

Thereafter, from the decompressed state, an incombustibility treatment agent heated to 80° C. was quickly filled into the hermetic vessel (for about 12 minutes) (first decompression impregnation step).

The incombustibility treatment agent used in this step was dispensed as shown below.

Incombustibility Treatment Agent:

| | |
|---|---|
| Borax | 17 parts |
| Boric acid | 9 parts |
| Phosphoric acid | 1 part |
| Additives (organic leaching preventive) | 3 parts |
| Water | 70 parts |
| Total | 100 parts |

Processing was performed for 60 minutes by maintaining the interior of the hermetic vessel, as is filled with the incombustibility treatment agent, to a compression pressure of 1 MPa and 80° C. (first compression impregnation step).

Subsequently, the test pieces impregnated with the incombustibility treatment agent were re-stored into the decompression-dedicated hermetic vessel and dried at a condition of 60 to 80° C. for 12 days to a moisture content of 25% (second drying step). In this stage, an average impregnation amount of the fixed incombustibility treatment agent was 170 kg/m$^3$.

The dried test pieces were put into the decompression-dedicated hermetic vessel, again decompressed to a negative pressure of −0.98 MPa, and left in that state for 60 minutes (second decompression step).

Thereafter, from the decompressed state, the incombustibility treatment agent heated to 80° C. was filled into the hermetic vessel, and the test pieces were immersed therein (second decompression impregnation step).

Subsequently, the interior of the hermetic vessel filled with the incombustibility treatment agent was maintained at a compression pressure of 1 MPa and 80° C. and left in that state for 180 minutes (second compression impregnation step).

Subsequently, the test pieces impregnated with the incombustibility treatment agent were re-stored into the drying vessel, and are again dried at a condition of 60 to 80° C. for 14 days to a moisture content thereof of 15% (third drying step).

In this stage, an average impregnation amount of the fixed incombustibility treatment agent was 280 kg/m$^3$.

In the event that completely the same process was performed except that the incombustibility treatment agent was heated to 45° C. and maintained thereat in the second compression impregnation step, an average impregnation amount was 280 kg/m$^3$, whereby the requirements of the standard for the incombustion agent were verified as being satisfied.

Cone calorimeter testing (ISO 5660) was performed for the two test pieces which underwent the process described above.

In this case, heating was performed for 20 minutes at an emission intensity of 50 kW/m$^2$ over the surface of the test piece.

Testing conditions and testing results are shown in Table 2.

Comparative Example 1

Two test pieces (cryptomeria boards) were prepared: one having a size of 100 mm (width)×100 mm (length)×24 mm (thickness) and the other having a size of 100 mm (width)×100 mm (length)×24 mm (thickness).

Figure 4:
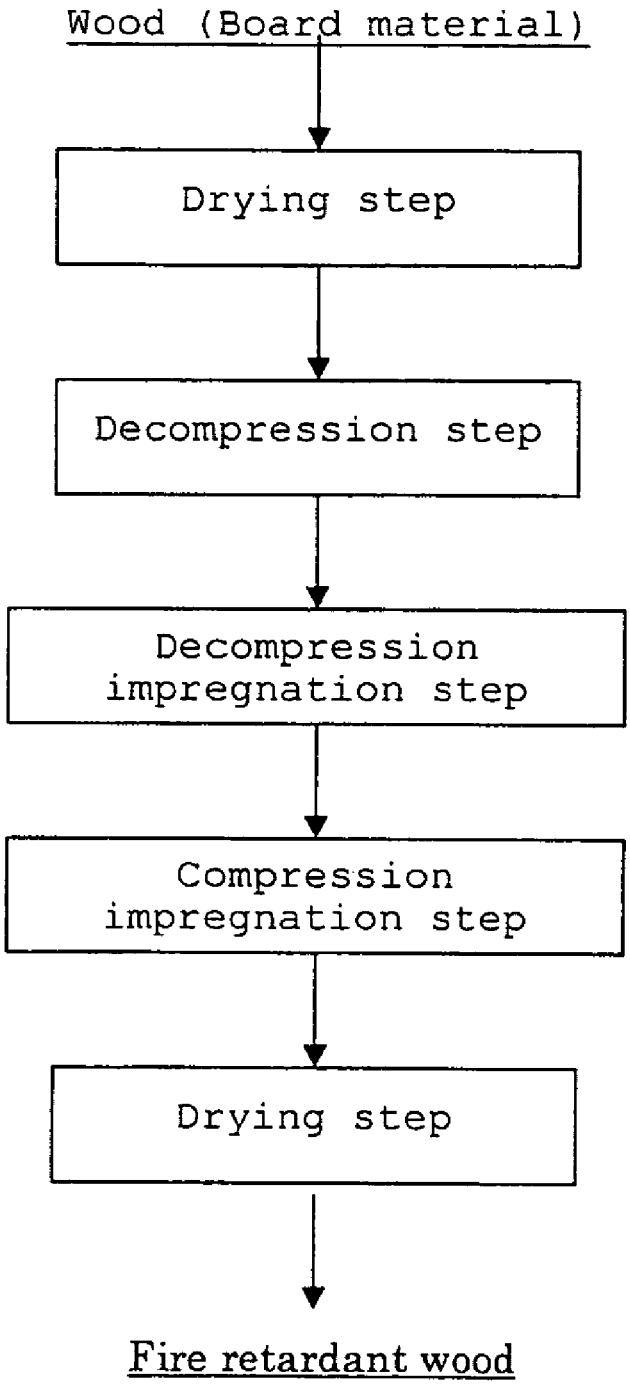
FIG. 4 is a view showing steps of a method of manufacturing incombustible wood according to a conventional example (comparative example 1).

Then, an incombustibility treatment according to the conventional method with processing steps shown in FIG. 4.

Specifically, first, the two test pieces were dried in a drying vessel (supplied by Shin-Shiba Setsubi Kougyo Co., Ltd.) in a heating temperature range of 45 to 70° C. to a moisture content of 7% (first drying step).

Subsequently, the test pieces were put into a compression/decompression-dedicated hermetic vessel (supplied by Hanayama Kogyo Co., Ltd.) and were tested for 60 minutes by conducting decompression to a negative pressure of −0.98 MPa (first decompression step).

Thereafter, from the decompressed state, an incombustibility treatment agent heated to 80° C. was filled into the hermetic vessel (first decompression impregnation step).

In this step, the same incombustibility treatment agent as that in the above-described step was used.

Processing was performed for 60 minutes by maintaining the interior of the hermetic vessel, as is filled with the incombustibility treatment agent, to a compression pressure of 1 MPa and 80° C. (first compression impregnation step).

Subsequently, the test pieces impregnated with the incombustibility treatment agent were re-stored into the drying vessel and again dried at a condition of 60 to 80° C. for 14 days to a moisture content of 15% (second drying step).

Cone calorimeter testing (ISO 5660) was performed for the two test pieces which underwent the process described above.

In this case, heating was performed for 20 minutes at an emission intensity of 50 kW/m$^2$ over the surface of the test piece.

Testing conditions and testing results are shown in Table 2.

Comparative Example 2

Figure 5:
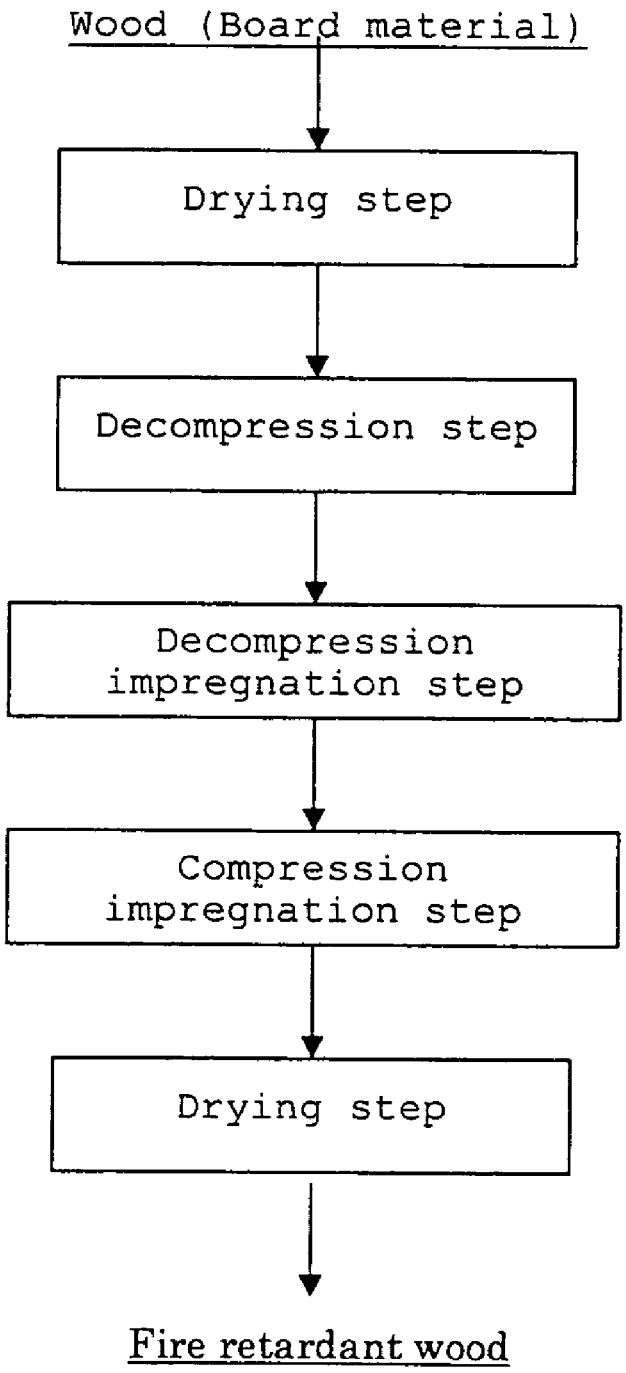
FIG. 5 is a view showing steps of a method of manufacturing incombustible wood according to a conventional example (comparative example 2).

The process in this case was performed in such a manner that, after the first compression impregnation step in comparative example 1 was performed, the second decompression step, the second decompression impregnation step, and second compression impregnation step were further repeatedly performed without performing the second drying step (refer to FIG. 5).

That is, the first decompression step, the first decompression impregnation step, and the first compression impregnation step were performed under conditions similar to those of the comparative example 1.

Subsequently, the test pieces were immediately put into a different compression/decompression-dedicated hermetic vessel (supplied by Hanayama Kogyo Co., Ltd.) and were tested for 60 minutes by conducting decompression to a negative pressure of −0.98 MPa (second decompression step).

Thereafter, with the decompressed state being maintained, an incombustibility treatment agent heated to 80° C. was filled into the hermetic vessel (second decompression impregnation step).

In this step, the same incombustibility treatment agent as that in the above-described examples was used.

The interior of the hermetic vessel, as is filled with the incombustibility treatment agent, was maintained at a compression pressure of 1 MPa and 80° C. and left in that state for 180 minutes (second compression impregnation step).

In addition, the test pieces impregnated with the incombustibility treatment agent were re-stored into the drying vessel and again dried at a condition of 60 to 80° C. for 14 days to a moisture content of 15% (third drying step).

Cone calorimeter testing (ISO 5660) was performed for the two test pieces which underwent the process described above.

In this case, heating was performed for 20 minutes at an emission intensity of 50 kW/m$^2$ over the surface of the test piece.

Testing conditions and testing results are shown in Table 2.

Comparative Example 3

The process was performed under the same conditions in all aspects as those in comparative example 1, except that the temperature of the incombustibility treatment agent in the first compression impregnation step in comparative example 1 was an ordinary temperature (in this case, it was a room temperature of 18° C.).

Cone calorimeter testing (ISO 5660) was performed for the two test pieces which underwent the process described above.

In this case, heating was performed for 20 minutes at an emission intensity of 50 kW/m$^2$ over the surface of the test piece.

Testing conditions and testing results are shown in Table 2.

From the factors such as the example and the comparative examples, it should be able to be understood that according to the present invention, the manufacturing method exhibits very high fixability of the incombustibility treatment agent.

In addition, it can be understood that when the impregnation amount of the incombustibility treatment agent is 240 kg/m$^3$ or greater, the requirements of the standard for the incombustible materials can be satisfied.

INDUSTRIAL APPLICABILITY

As described above, the manufacturing method according to the present invention is the method of manufacturing incombustible wood by impregnating the wood with the incombustibility treatment agent.

The method can be used for materials other than wood in any field in which similar effects can be expected as long as the use departs from the principles of the method.

TABLE 1

| | Fire-retardant material | Semi-incombustible material | Incombustible material |
|---|---|---|---|
| Heating time | 5 minutes | 10 minutes | 20 minutes |
| Emission intensity | | 50 kW/m$^2$ | |
| Judgment criteria | 1) A total heating value shall be 8 MJ/m$^2$ or lower.<br>2) Neither crack nor pore passing through to a reverse side, which is detrimental to fire retardation, shall be present.<br>3) A maximum heating rate shall continue for 10 seconds or longer and shall not exceed 200 kW/m$^2$.<br>4) In gas toxicity testing, an average deactivation time of a mouse shall be 6.8 minutes or longer. | | |

TABLE 2

| | Embodiment example | Comparative example 1 | Comparative example 2 | Comparative example 3 |
|---|---|---|---|---|
| Incombustibility treatment agent | Borax 17%<br>Boric acid 9%<br>Phosphoric acid 1%<br>Organic leaching preventive 3%<br>Water 70% | Borax 17%<br>Boric acid 9%<br>Phosphoric acid 1%<br>Organic leaching preventive 3%<br>Water 70% | Borax 17%<br>Boric acid 9%<br>Phosphoric acid 1%<br>Organic leaching preventive 3%<br>Water 70% | Borax 17%<br>Boric acid 9%<br>Phosphoric acid 1%<br>Organic leaching preventive 3%<br>Water 70% |

TABLE 2-continued

| | Embodiment example | Comparative example 1 | Comparative example 2 | Comparative example 3 |
|---|---|---|---|---|
| Temperature of incombustibility treatment agent | 80° C. | 80° C. | 80° C. | Normal temperature (Room temperature 18° C.) |
| | First drying Moisture content: 7%<br>↓<br>First decompression: 60 min.<br>↓ −0.98 MPa<br>First decompression impregnation<br>↓<br>First compression impregnation: 60 min.<br>↓ 80° C. 1 MPa<br>Second drying Moisture content: 25%<br>↓<br>Second decompression: 60 min.<br>↓ −0.98 MPa<br>Second decompression impregnation<br>↓<br>Second compression impregnation: 180 min.<br>↓ 80° C. 1 Mpa<br>Third drying Moisture content: 15% | Drying Moisture content: 7%<br>↓<br>Decompression: 60 min.<br>↓ −0.98 MPa<br>Decompression impregnation<br>↓<br>Compression impregnation: 180 min.<br>↓ 80° C. 1 MPa<br>Drying Moisture content: 15% | Drying Moisture content: 7%<br>↓<br>Decompression: 60 min.<br>↓ −0.98 MPa<br>Decompression impregnation<br>↓<br>Compression impregnation: 180 min.<br>↓ 80° C. 1 MPa<br>Decompression: 60 min.<br>↓ −0.98 MPa<br>Decompression impregnation<br>↓<br>Compression impregnation: 180 min.<br>↓ 80° C. 1 Mpa<br>Drying Moisture content: 15% | Drying Moisture content: 7%<br>↓<br>Decompression: 60 min.<br>↓ −0.98 MPa<br>Decompression impregnation<br>↓<br>Compression impregnation: 180 min.<br>↓ 18° C. 1 MPa<br>Drying Moisture content: 15% |
| Average impregnation amount (kg/m$^3$) | 280 | 195 | 207 | 123 |
| Incompatibility (Building Standard law) | Incombustible material | Semi-incombustible material | Semi-incombustible material | Fire-retardant material |

The invention claimed is:

1. A method of manufacturing incombustible wood, comprising the sequential steps of:

(1) drying wood;

(2) decompressing the wood in a decompression vessel;

(3) immersing the wood in an incombustibility treatment agent in the decompression vessel to impregnate tissues of the wood with the incombustibility treatment agent;

(4) compressing the wood while the wood is immersed in the incombustibility treatment agent in the decompression vessel to further impregnate the tissues of the wood with the incombustibility treatment agent;

(5) drying the wood a second time;

(6) decompressing the wood a second time in the decompression vessel;

(7) immersing the wood again in the incombustibility treatment agent in the decompression vessel to again impregnate the tissues of the wood with the incombustibility treatment agent;

(8) compressing the wood again while the wood is immersed in the incombustibility treatment agent in the decompression vessel to further impregnate the tissues of the wood with the incombustibility treatment agent; and (9) drying the wood a third time.

2. The method of manufacturing incombustible wood according to claim 1, characterized in that in the first drying step, the drying is performed by heat drying to a moisture content of 15% or lower.

3. The method of manufacturing incombustible wood according to claim 1, characterized in that in the second drying step, the drying is performed by heat drying to a moisture content of 30% or lower.

4. The method of manufacturing incombustible wood according to claim 1, characterized in that in the third drying step, the drying is performed by heat drying to a moisture content of 15% or lower.

5. The method of manufacturing incombustible wood according to claim 1, characterized in that in the decompression steps, processing is performed for a predetermined time at a negative pressure of −1.0 MPa to −0.7 MPa.

6. The method of manufacturing incombustible wood according to claim 1, characterized in that in the compression steps, processing is performed for a predetermined time at a compression level of 0.7 MPa to 2.0 MPa.

7. The method of manufacturing incombustible wood according to claim 1, characterized in that when the third drying step has been completed, the incombustibility treatment agent in solids amount is 240 kg/m$^3$ or greater.

8. The method of manufacturing incombustible wood according to claim 1, characterized in that the temperature of the incombustibility treatment agent in the second compression step is 60° C. to 90° C.

9. The method of manufacturing incombustible wood according to claim 1, characterized in that the incombustion treatment agent is a treatment agent containing at least borax, boric acid, and phosphoric acid.

* * * * *